US006397423B1

(12) United States Patent
Sessler, Jr. et al.

(10) Patent No.: US 6,397,423 B1
(45) Date of Patent: Jun. 4, 2002

(54) APPARATUS FOR CATCHING DEBRIS WHILE DEMOLISHING A BRIDGE STRUCTURE

(75) Inventors: LaVerne M. Sessler, Jr.; Craig L. Sessler, both of Geneva, NY (US)

(73) Assignee: L. M. Sessler Excavating and Wrecking, Inc., Waterloo, NY (US)

( * ) Notice: Subject to any disclaimer, the term of this patent is extended or adjusted under 35 U.S.C. 154(b) by 0 days.

(21) Appl. No.: 09/688,517

(22) Filed: Oct. 16, 2000

Related U.S. Application Data

(63) Continuation-in-part of application No. 09/326,842, filed on Jun. 7, 1999, now Pat. No. 6,155,649.

(51) Int. Cl.[7] ..... E04G 13/00
(52) U.S. Cl. ..... 14/78; 52/DIG. 12; 248/228.1
(58) Field of Search ..... 248/48.1, 48.2, 248/235, 228.1; 52/DIG. 12; 14/77.1, 78

(56) References Cited

U.S. PATENT DOCUMENTS 2,264,498 A * 12/1941 Alloway ..... 248/235
3,595,510 A * 7/1971 Hutchinson ..... 248/175
4,086,978 A * 5/1978 Clements ..... 248/235 X
4,660,800 A * 4/1987 Horstketter ..... 248/235 X
6,003,630 A * 12/1999 Whalen ..... 182/82
6,266,939 B1 * 7/2001 Yates et al. ..... 52/DIG. 12

* cited by examiner

*Primary Examiner*—David Bagnell
*Assistant Examiner*—Sunil Singh
(74) *Attorney, Agent, or Firm*—Greenwald & Basch LLP; Howard J. Greenwald

(57) ABSTRACT

An overhang bracket for preventing the discharge of debris from a structure which contains a bracket deck integrally connected to a bracket frame. The bracket deck and bracket frame preferably each has a length of from about 4 to about 15 feet. The bracket deck is preferably substantially L-shaped, with a horizontal and vertical surface disposed vis-a-vis each other at an angle of from about 60 to about 150 degrees; and it has a load capacity of from about 50 to about 1,000 pounds. The bracket frame contains at least two triangular braces. The bracket deck and/or the bracket frame contains an orifice which extends inwardly.

13 Claims, 6 Drawing Sheets

FIG. 4
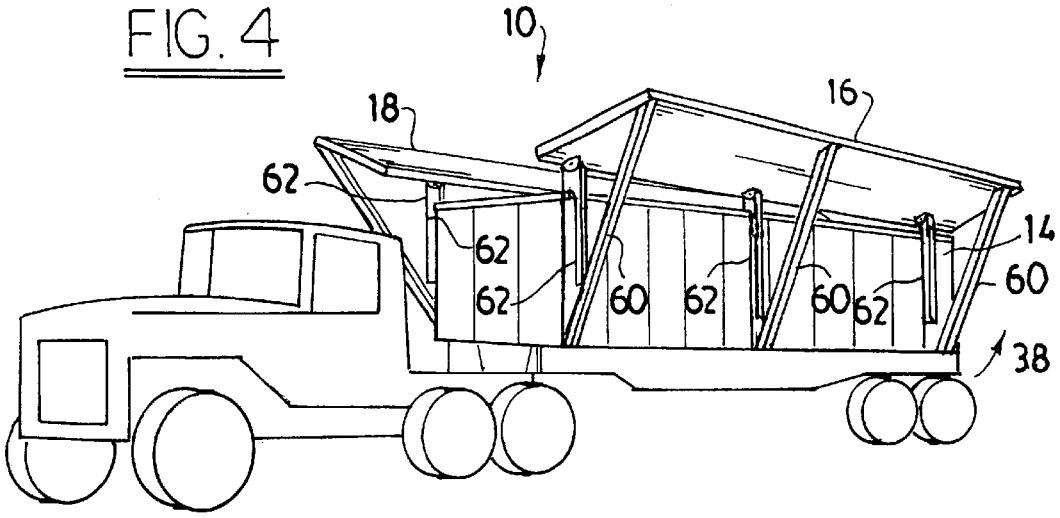
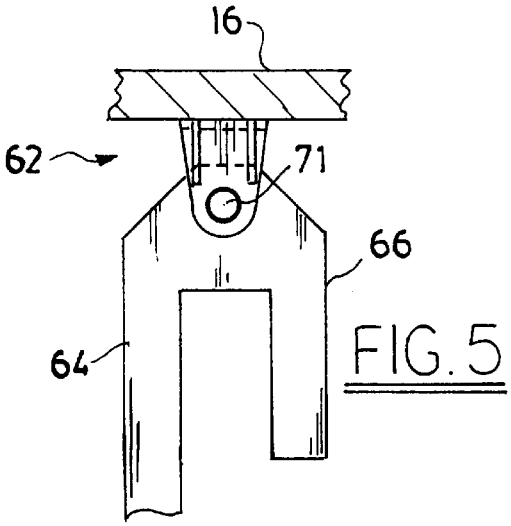
FIG. 5
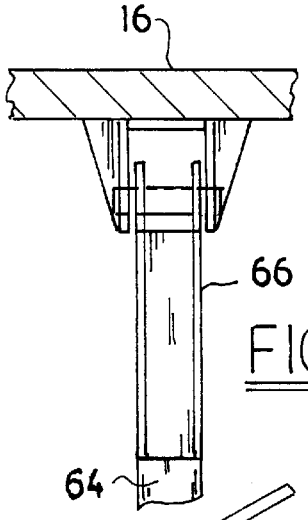
FIG. 6
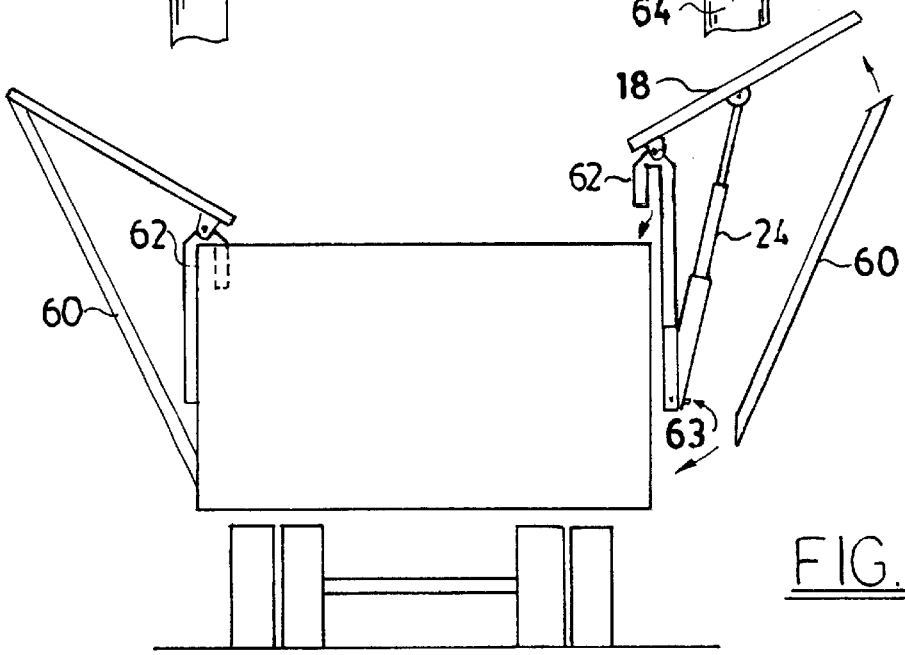
FIG. 7

APPARATUS FOR CATCHING DEBRIS WHILE DEMOLISHING A BRIDGE STRUCTURE

CROSS-REFERENCE TO RELATED PATENT APPLICATION

This application is a continuation-in-part of applicants' copending patent application 09/326,842, filed on Jun. 7, 1999 now U.S. Pat. No. 6,155,649.

FIELD OF THE INVENTION

An apparatus useful in assisting with a process for demolishing a bridge structure. The apparatus comprises an overhang bracket for preventing the discharge of debris from the bridge. The overhang bracket comprises a bracket deck integrally connected to a bracket frame.

BACKGROUND OF THE INVENTION

U.S. Pat. No. 4,955,972 of Roy E. LaBounty discloses a container for catching falling debris from bridge deck demolitions. In the process described in this patent, a crane is disposed near a bridge deck and suspends a receptacle by means of a support arm connected to the receptacle. Thereafter, by means of a cable connected to the receptacle and the crane, the receptacle is tilted so that crushed, collected concrete slides off of an open end of the receptacle and into a dump truck.

To the best of applicants' knowledge, no prior art reference discloses an overhang bracket which may be attached to a bridge in modular fashion and used to prevent debris from falling from such bridge. It is an object of this invention to provide such an overhang bracket.

SUMMARY OF THE INVENTION

In accordance with this invention, there is provided an overhang bracket for preventing the discharge of debris from a structure which is comprised of a bracket deck integrally connected to a bracket frame.

BRIEF DESCRIPTION OF THE DRAWINGS

The claimed invention will be described by reference to the specification and to the enclosed drawings, in which like numerals refer to like elements, and in which:

FIG. 4 is a perspective view of another preferred truck with a dump trailer which can be used in the process of this invention;

FIG. 5 is a front view of a connector which may be used to connect one or more wings to the dump trailer depicted in FIG. 4;

FIG. 6 is a side view of the connector of FIG. 5;

FIG. 7 is a schematic illustration of one preferred means for supporting the wings of the truck of FIG. 4;

DESCRIPTION OF THE PREFERRED EMBODIMENTS

The remainder of this specification will describe several distinct inventions. In the first section, a winged truck assembly 10 will be described. Thereafter, an overhang bracket 70 will be described.

Figure 1:
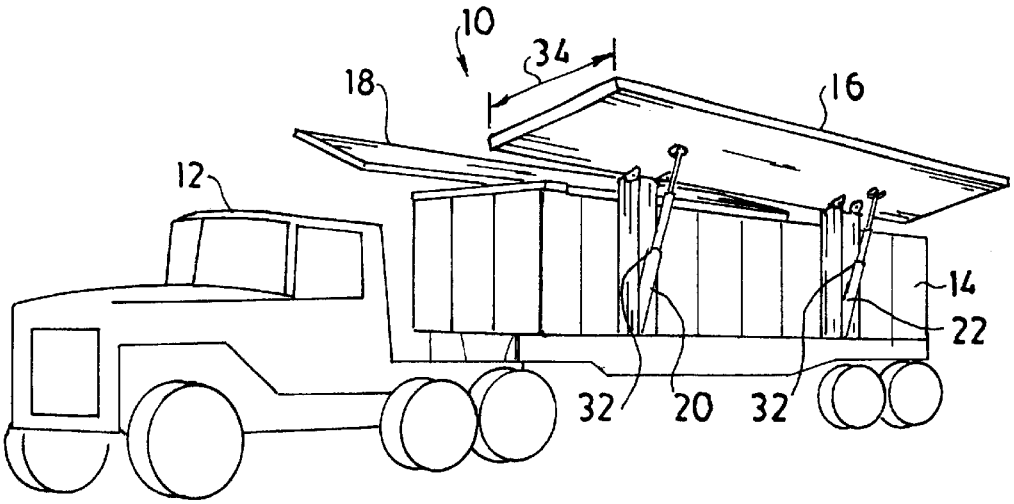
FIG. 1 is a perspective view of one preferred truck with a dump trailer which can be used in the process of this invention.

FIG. 1 illustrates a preferred winged tractor trailer 10 which may be used in the process of the invention. Referring to FIG. 1, it will be seen that winged tractor trailer 10 is comprised of a truck 12 attached by conventional means to a rear dump trailer 14. As is known to those skilled in the art, a rear dump trailer is a receptacle with means for removably connecting the trailer to a tractor (such as a truck), a multiplicity of wheels attached to the trailer, and means for removing debris contained in the dump trailer by tilting the trailer up and away from the trailer bed at an angle greater than about 30 degrees and removing the debris from the rear of the trailer. These and similar dump trailers are well known to those skilled in the art and are described, e.g., in U.S. Pat. No. 5,782,538 (end dump trailer), U.S. Pat. No. 5,681,095 (dump body for a vehicle), U.S. Pat. No. 5,662,374 (dump body), U.S. Pat. No. 5,482,356 (rear dump trailer), U.S. Pat. No. 4,968,096 (dump trailer with lifting mechanism), U.S. Pat. No. 4,659,147 (dump trailer), U.S. Pat. No. 4,616,879, and the like. The entire description of each of these United States patents is hereby incorporated by reference into this specification.

In one embodiment, not shown, a dump truck is used instead of the dump trailer assembly 14. Such dump trucks are well known to those skilled in the art and are described, e.g., in U.S. Pat. Nos. 5,588,712, 5,452,942, 5,407,251, 4,955,972, 3,881,764, 3,601,447, and the like. The disclosure of each of these United States patents is hereby incorporated by reference into this specification.

As will apparent to those skilled in the art, many different types of truck assemblies may be used in the process of this invention. What they all preferably have in common, however, is a receptacle for receiving debris, and some means of moving the receptacle, which means commonly comprise a set of at least wheels operatively connected to a motor.

In one embodiment, discussed later in this specification, a barge comprised of a receptacle is disposed within a waterway underneath a bridge.

In another embodiment, a movable receptacle which does not contain motorized means is used to receive debris. Such receptacle may be, e.g., a trailer which is pushed or pulled by a motorized vehicle.

In the remainder of this specification, the invention will be described by reference to a truck. It should be understood however, that the comments made with regard to the use of such truck are also applicable to other means of receiving debris from a demolished bridge.

Figure 3:
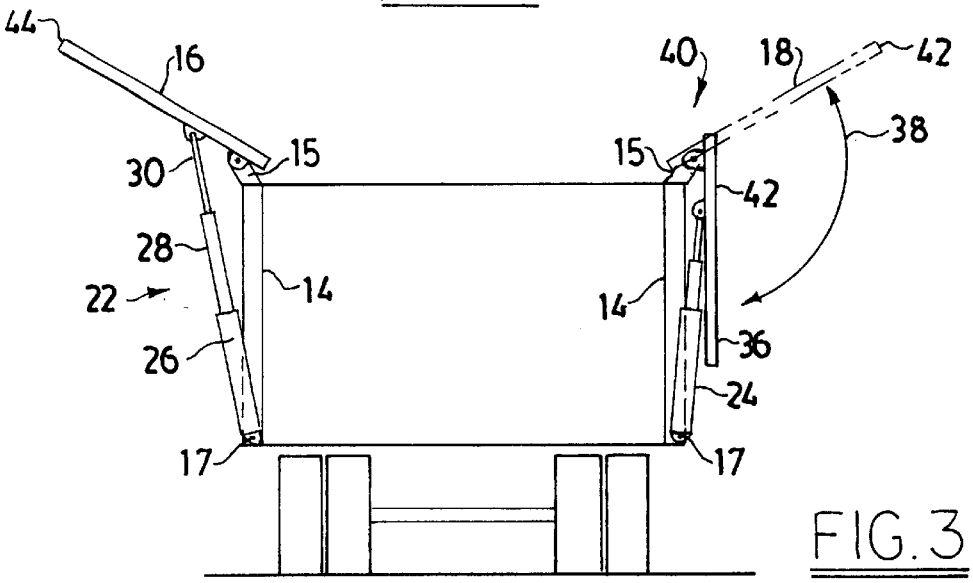
FIG. 3 is a back view of the truck of FIG. 1

FIG. 3 illustrates wing 18 in its initial position 36. After it is raised, preferably by means of two-stage hydraulic cylinder 24, it will be seen that wing 18 will have moved upwardly and outwardly in the direction of arrow 38 to the position 40 depicted in dotted line outline in FIG. 3.

The angle between the initial position 36 of wing 18 and its final position 40 is generally from about 10 to about 180 degrees. It is generally preferred that angle be from about 60 to about 150 degrees and, even more preferably, from about 100 to about 150 degrees. It one preferred embodiment, the top surfaces, 42 and 44, of wings 18 and 16 actually touch the bottom 46 of the bridge structure being worked on.

Referring again to FIG. 3, it will be seen that wings 16 and 18 are preferably rotatably attached to trailer 14 by means of bracket 15, which is preferably integrally joined to trailer 14 by conventional means, such as welding. The bracket 15 is also connected to the wings 16 and 18 by conventional fasteners, such as, e.g., a solid pin. The two-stage hydraulic cylinder assemblies 24 and 22 are attached to trailer 14 by means of, e.g., brackets 17, each of which also is preferably integrally connected to trailer 14 by welding.

As will be apparent to those skilled in the art, the wings 16 and 18 are hingably attached to trailer 14 by means allowing the simultaneous rotation of wings 16 and 18 and of hydraulic cylinders 24 and 26.

Figure 2:
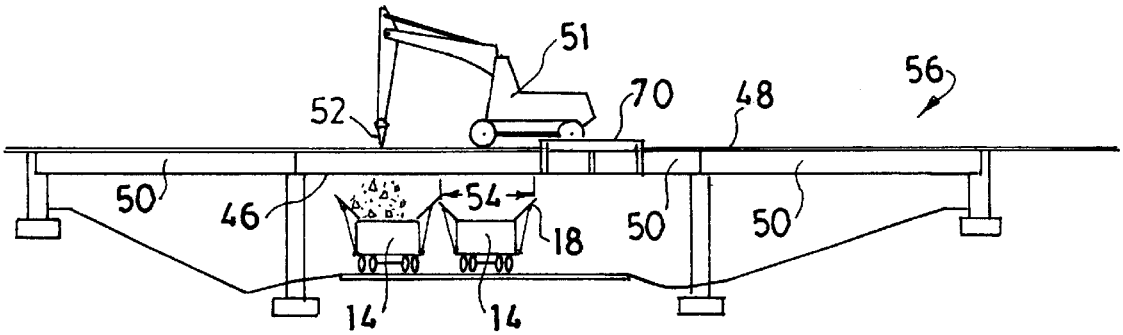
FIG. 2 is a schematic view illustrating how two of the trucks of FIG. 1 may be used in the process of the invention.

FIG. 2 illustrates one aspect of applicants' claimed process. In this embodiment, a bridge deck 48 is being demolished. As is known to those skilled in the art, a bridge deck is the surface of the bridge upon which vehicular traffic rides and can be comprised of or consist of concrete, steel, wood, etc. In one preferred embodiment, the bridge deck 48 consists essentially of reinforced concrete supported by steel girders 50.

Reinforced concrete bridge decks are well known to those skilled in the art and are described, e.g., in U.S. Pat. Nos. 5.579,361, 5,664,378, 5,639,358, 5,595,034, 5,509,243, 5,449,563, 5,427,819, and the like. The entire disclosure of each of these United States patents is hereby incorporated by reference into this specification.

Referring again to FIG. 1, it will be seen that dump trailer 14 is connected to wings 16 and 18. These wings 16 and 18 may be raised and/or lowered by a hydraulic lift system comprised of hydraulic cylinder assemblies 20, 22 (see FIG. 1), and 24 (see FIG. 3).

The hydraulic lift system is preferably a two-stage hydraulic lift system. Thus, referring to FIG. 3, it will be seen that hydraulic cylinder assembly 22 is comprised of hydraulic cylinder 26 within which is disposed hydraulic cylinder 28 within which is disposed rod 30. Thus, the two stage hydraulic lift system operates by first extending cylinder 28 by means of hydraulic pressure, and thereafter extending rod 30 by means of hydraulic pressure.

Two stage hydraulic cylinder assemblies, and means for controlling them, are well known to those skilled in the art and are described, e.g., in U.S. Pat. No. 5,829,947 (two stage hydraulic lift cylinder), U.S. Pat. No. 5,649,424 (two stage pressure cylinder), U.S. Pat. No. 5,551,391 (control system for two stage hydraulic lift cylinder), U.S. Pat. Nos. 5,467, 754, 5,341,837, 5,241,935, 4,852,464 (two stage telescoping hydraulic cylinder), U.S. Pat. No. 4,172,612 (two stage telescopic hydraulic cylinder), and the like. The entire disclosure of each of these United States patents is hereby incorporated by reference into this specification.

Thus, in the process of the invention, hydraulic cylinder 28 is first raised, and then rod 30 is then raised. Conversely, when hydraulic pressure has been removed, rod 30 is first retracted and lowered, and then hydraulic cylinder 28 is then retracted and lowered.

Referring again to FIG. 1, and in the preferred embodiment depicted therein, it will be seen that means for locking hydraulic cylinders 20, 22, et seq. are provided. In the preferred embodiment illustrated, manual hydraulic shut off valves 32 are provided, preferably one for each hydraulic cylinder assembly. These shut off valves 32, or similar structure, may be used to lock each such hydraulic cylinder assembly in place once it has reached the desired position.

Each of wings 16 and 18 preferably each have a width 34 of from about 4 to about 8 feet. It is preferred that the lengths of the wings be substantially equal to the lengths of the trailer 14 and/or the dump truck (not shown) to which the wings are connected.

FIG. 2 illustrates one preferred embodiment in which two winged tractor trailers 10 are used. In this embodiment, an excavator 51 equipped with a hydraulic hoe ram 52 is used to demolish the bridge deck 48. One may use other demolition means such as, e.g., those described in U.S. Pat. Nos. 5,014,381, 4,955,972, 4,641,581 (use of explosive charges), U.S. Pat. No. 4,633,975, and the like. The disclosure of each of these United States patents is hereby incorporated by reference into this specification.

In one embodiment, not shown, concrete slab saws are used to cut the bridge deck. These concrete slab saws are well known and are described, e.g., in U.S. Pat. Nos. 4,945,356, 4,938,201, 4,928,662, 4,889,675, 4,769,201, 4,310,198, and the like. The entire disclosure of each of these United States patents is hereby incorporated by reference into this specification.

In one aspect of this embodiment, the bridge deck 48 is cut into substantially rectangular slabs with a width of from about 5 to about 9 feet and a length of from about 6 to about 19 feet; it is preferred that each such slab be supported, at least in part, by one or more steel girders 50. Thereafter, each such slab is then hoisted off of the bridge by means of a hydraulic excavator 51 and/or a crane (not shown).

In another embodiment, the bridge deck 48 is cut into the aforementioned slabs by means of hydraulic excavator 51/hoe ram 52 (see FIG. 2) and thereafter, hoisted off the bridge, preferably by means of excavator 51. In this embodiment, it is preferred to cut the slab by means of the hoe ram 52, and thereafter support the cut slab with the hoe ram 52 while cutting the reinforcement bars on the left and right sides of the slab by means of a torch (such as an oxy-acetylene torch), and thereafter fold the slab back towards the excavator 51, and thereafter cut the reinforcement bars on the back side of the slab.

Referring to FIG. 2, rear dump trailers 14 is completely disposed under the bridge deck 48. With wings 16 and 18 extended, the effective width 54 if presented to the deck is from about 9 to about 24 feet. Inasmuch as rear dump trailers 14 may be from about 16 to about 40 feet in length, the cross-sectional area provided by the winged receptacles to deck 48 is substantial. In general, an effective cross-sectional area of at least 500 square feet is provided to catch debris from deck 48. It is preferred that the effective cross-sectional area be from about 600 to about 800 square feet.

In one embodiment, not shown in FIG. 2, the wings 16 and 18 contact the bottom 46 of the bridge 56. In this embodiment, the receptacles formed by the bottom of the bridge 46, the upstanding wings 16 and 18, and the trailer 14, effectively protect vehicular traffic and/or persons near bridge from flying debris.

FIG. 4 is a perspective view of a dump trailer 14 equipped with wings 16 and 18 wherein the wings are supported by means of arms 60 and brackets 62.

FIG. 5 is a front view of a preferred bracket 62. Referring to FIG. 5, and in the preferred embodiment depicted, it will be seen that leg 64 is preferably longer than leg 66. The bracket 62 is preferably connected to wing 16 by means of pin 71. As will be apparent, the pin 70 allows the wing 16 to swivel upwardly and outwardly.

Thus, referring again to FIG. 4, wings 16 and 18 may be swiveled upwardly and outwardly in the direction of arrow 38 and, when it has reached its desired position, be held in place by stiff legs 60. One may use one-piece stiff legs 60 with a specified length. Alternatively, or additionally, one may use adjustable stiff legs with variable lengths.

As will be apparent, brackets 62 may be removably mounted on trailer 14, and/or they may be integrally and permanently affixed to the trailer by conventional means.

In the device illustrated in FIG. 7, two different means fo raising wing 18 are shown. In one embodiment, as described above, the wing 18 may be moved upwardly by external means as described above and held in place by stiff leg 60. Alternatively, or additionally, the wing 18 may be moved upwardly and outwardly by means of hydraulic cylinder assembly 24 (see, e.g., FIG. 5) and locked in place by the locking means provided on such assembly 24. As will be apparent to those skilled in the art, the structure depicted in FIG. 7 differs from the structure depicted in FIG. 1 in that the hydraulic assembly 24 is hingably attached to bracket 62 rather than to trailer 14, and the bracket 62/hydraulic device 24 assembly can readily be attached or detached from a truck (see FIG. 6). It will also be apparent that such bracket 62/hydraulic device 24 assembly can readily be attached or detached from a barge, from a non-motorized receptacle, from a building, etc.

The bracket 62/hydraulic device 24 assembly preferably includes means for receiving or transmitting hydraulic fluid or air. In general, a port 63 is disposed on such cylinder to receive or dispose of hydraulic fluid or pressurized air therein.

A novel overhang bracket

FIG. 2 shows that, in the process depicted therein, in addition to using two winged tractor trailers 10 to catch failing debris, one may also use one or more overhang brackets 70 to catch debris in areas where the tractor-trailer assemblies 10 are not located. These overhang brackets 70 also serve to protect vehicular and pedestrian traffic under the bridge 56 while work is in progress.

As will be apparent, these overhang brackets may be used with or without the winged tractor trailers 10, and they may be used on buildings, bridges, etc.

Figure 9:
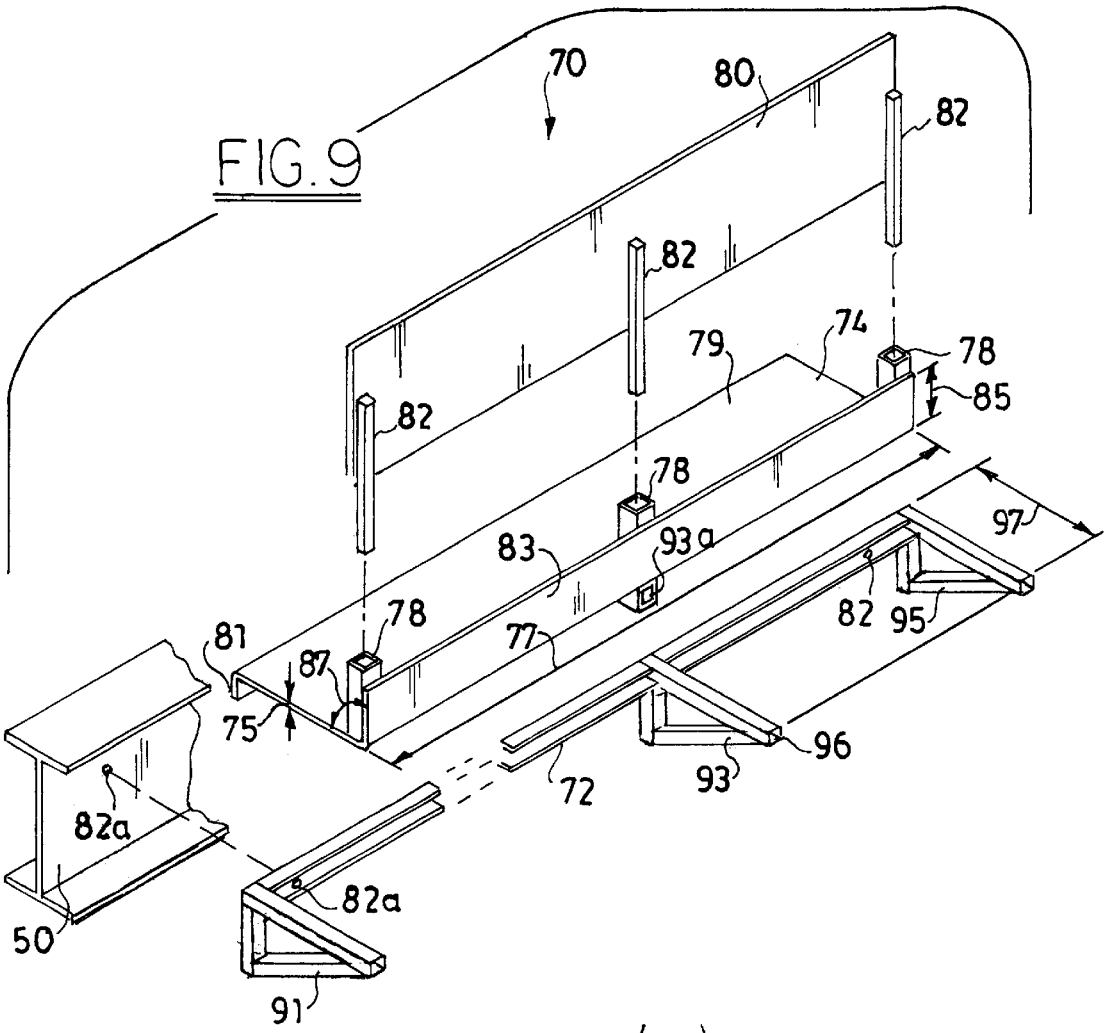
FIG. 9 is an exploded view of the overhang bracket assembly of FIG. 8.

One preferred embodiment of overhang bracket 70 is illustrated in FIG. 9. Referring to FIG. 9, and in the preferred embodiment depicted therein, it will be seen that bracket 70 is comprised of an bracket frame 72 and bracket deck 74 integrally connected to each other by conventional means such as, e.g., welding or by means of bolts.

The bracket frame 72, in the embodiment depicted, is comprised of triangular braces 76. In the embodiment depicted, three such triangular braces are present. In general, it is preferred to use from about 2 to 4 such triangular braces.

The bracket deck 74 is preferably made from formed sheet metal to which are connected a multiplicity of post supports 78 preferably made from box tubing. Three such post supports are illustrated in FIG. 9, but from about 2 to about 4 such post supports 78 may be used.

As is illustrated in FIG. 9, removably connected to the bracket deck 74 is a splatter guard 80 which is comprised of a multiplicity of box tubing inserts 82 adapted to be received within post supports 78. The splatter guard 80 is preferably constructed from sheet metal or plywood.

Referring again to FIG. 9, it will be seen that the bracket frame 72/bracket deck 74 assembly, after the two pieces have been integrally connected to each other, may be joined to bridge girder 50 by means of connectors (not shown) disposed in orifices 82*a*. In the embodiment depicted in FIG. 10, the orifices 82*a* (see FIG. 9) are lined up by means of crane or hydraulic excavator (not shown) from which cables 86 and 88 are suspended. The cables move an installation/removal bracket 90 into place so that, when moved in the direction of arrow 92, tube 94 may be inserted into orifice 96 of bracket frame 72 (see FIG. 9). After such insertion, the bracket frame 72/bracket deck 74 may be hoisted into a position appropriate to align orifices 82*a* (see FIG. 9).

One preferred process of the invention

Figure 11:
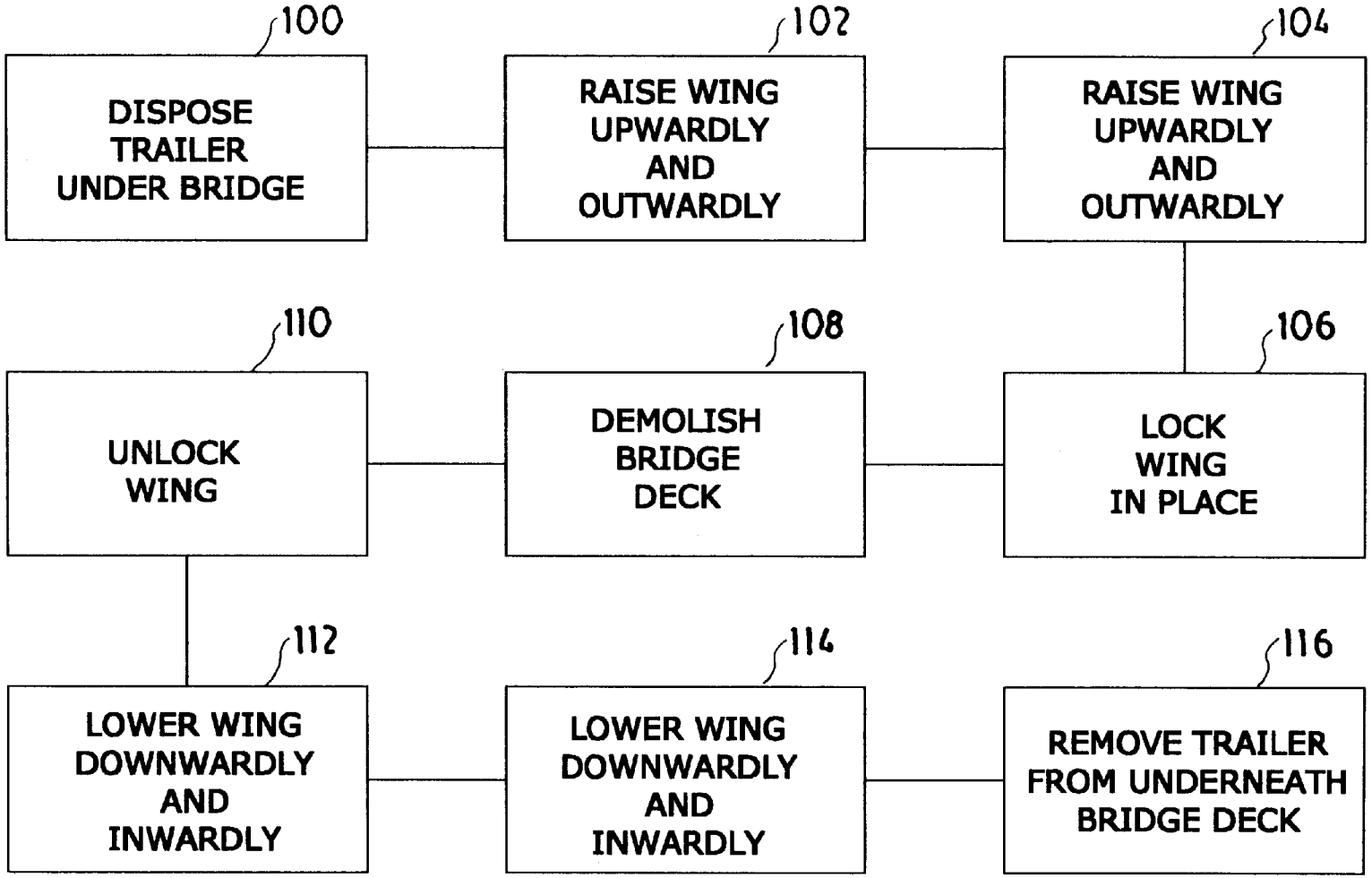
FIG. 11 is a flow diagram of one preferred process of the invention.

FIG. 11 illustrates one preferred process of the instant invention.

In step 100 of this process, one or more of tractor-trailers 10 is disposed under the bridge deck 48. In this step, it is preferred to so dispose the tractor-trailers 10 so that at least about 600 square feet of cross-sectional area is disposed above each such tractor trailer.

In one embodiment, not shown, the overhang bracket 70 is installed on the bridge deck prior to moving the tractor-trailer(s) 10 in place. In another embodiment, not shown, the overhang bracket 70 is installed on the bridge deck just after moving the tractor trailers 10 in place.

In step 102 of this process, wing 16 is initially raised upwardly and outwardly by means of a first hydraulic cylinder. Thereafter, in step 104 of this process, wing 16 is raised upwardly and outwardly by means of a rod.

Once the wing 16 has been raised to the desired position, it is preferably locked in place with shut off valves 32 in step 106. Thereafter, in step 108, the bridge deck 48 is demolished by conventional means.

It is preferred, after a section of bridge deck 48 has been demolished and/or after a truck receptacle has been completely filled, to lower the wing 16. Thus, in this preferred embodiment, in step 110, the wing 16 is preferably unlocked and, thereafter, in step 112, the wing 16 is moved downwardly and inwardly by retracting rod 30. Thereafter, in step 114 the wing 16 is further moved downwardly and inwardly by retracting hydraulic cylinder 28. Thereafter, in step 116, the tractor trailer 10 is driven away from the bride deck 48, preferably to a disposal area (not shown) where the debris may be dumped or removed by other conventional means.

Another preferred process of the invention

In this process of the invention, the overhang bracket 70 depicted in FIG. 9 is preferably used. It is preferred that, in such process, the bracket deck 74 and the bracket frame 72 each consist essentially of a metal-containing material such as steel and/or aluminum. In one embodiment, each of bracket deck 74 and bracket frame 72 consists essentially of steel. For the sake of simplicity of representation, this preferred assembly will be described in the remainder of this specification.

The steel used in the bracket deck 74 preferably has a thickness 75 of from about 0.05 to about 0.6 inches and, more preferably, from about 0.1 to about 0.5 inches. In one embodiment, thickness 75 is from about 0.1 to about 0.2 inches.

The bracket deck 74, and its corresponding bracket frame 72 and splatter guard 80, preferably have a length of from about 4 feet to about 20 feet and, more preferably, have a length of from about 4 feet to about 15 feet and, more preferably, have a length of from about 5 to about 10 feet. Because of these dimensions, the overhang bracket 70 assembly is relatively lightweight; and a multiplicity of such overhang brackets 70 may be readily mounted and dismounted on any particular structure, such as a bridge.

Figure 8:
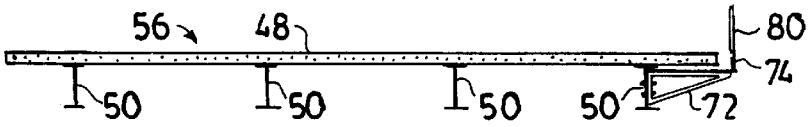
FIG. 8 is sectional view of a bridge structure to which is connected an overhang bracket assembly.

Referring to FIG. 8, and in the preferred embodiment depicted therein, it will be seen that the debris retaining surface 79 is preferably is preferably smooth and integral, with no orifices or crevices therein which might cause debris to attach to or pass through surface 79. Thus, referring to FIG. 10, and in the preferred embodiment depicted therein, it is preferred to attach bracket deck 74 to bracket frame 72 by means of a connection (which may be welded or bolted) between downwardly extending lip 81 of bracket deck 74 and bracket frame 72. Alternatively, or additionally, bracket frame 72 may be connected to bracket deck 74 by other welded connections at other locations. It is preferred that the resulting bracket frame 72/bracket deck 74 assembly be integral.

Referring again to FIG. 9, it will be seen that bracket deck 74 is comprised of an upwardly extending wall 83 which preferably has a height 85 of at least about 1 inch, more preferably at least about 2 inches and, even more preferably, from about 3 to about 36 inches.

The upwardly extending wall 83 preferably is integrally connected to debris retaining surface 79 and forms an angle 87 therewith of from about 60 to about 150 degrees and, preferably, from about 75 to about 120 degrees. In one embodiment, angle 87 is from about 85 to about 95 degrees.

Figure 10:
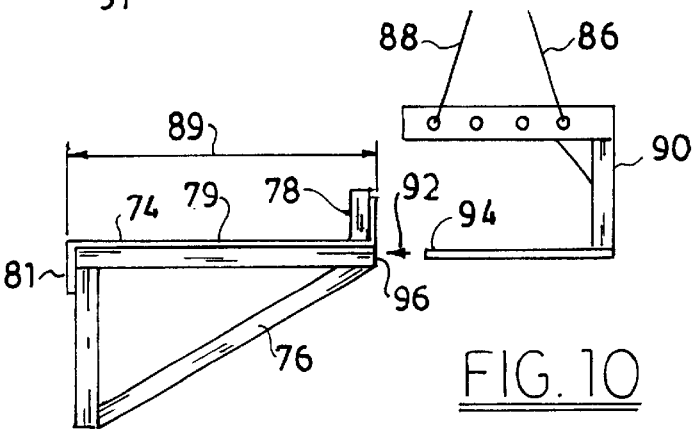
FIG. 10 is a schematic representation of disposing the overhang bracket assembly in a desired position.

Referring to FIG. 10, it will be seen that the width of bracket deck 74 is from about 12 to about 120 inches and, preferably, is from about 36 to about 60 inches. The bracket deck preferably has a load capacity of from about 50 to about 1,000 pounds per square foot and, more preferably, from about 100 to about 200 pounds per square foot. Means for measuring load capacity are well known and are described, e.g., in U.S. Pat. Nos. 5,934,199, 5,722,688, 5,671,532, 5,664,378, 5,611,570, 5,507,514, and the like. The entire disclosure of each of these United States patents is hereby incorporated by reference into this specification.

Referring again to FIG. 10, and in the preferred embodiment depicted therein, it will be seen that bracket frame 72 is comprised of a multiplicity of triangular braces 91, 93, and 95. It is preferred that at least two of such triangular braces 91 et seq. be present for each bracket frame 72, and preferably from about 2 to about 4 such triangular braces are used. It is preferred that the triangular braces 91 et seq. be substantially equidistant from each other. It is also preferred that the braces 91 et seq. have a cross-sectional shape which is substantially in the form of a right triangle.

Referring again to FIG. 9, and also to FIG. 10, it will be seen that bracket deck 74 and/or bracket frame 72 preferably comprise an orifice 93*a* or 96 in order to receive tube 94. Either or both of such orifices may be present in the assembly, and more than such orifice may be present in the assembly. It is preferred, however, that when tube 94 is inserted into one of such orifices, it be completely enclosed by such orifice such that when lifting force is applied, there is substantial contact between all portions of such tube and such orifice.

It is preferred that each of orifices 93*a* and 96 be substantially square or rectilinear so that the tube 94 (which also is preferably square) cannot rotate within such orifices. Other shapes which tend to prevent rotation (such as triangular, rectangular, hexagonal, octagonal, etc.) also may be used as long as, when tube 94 is engaged in such orifice, is cannot rotate therein wherein twisting force is applied thereto.

Referring again to FIG. 9, and in the preferred embodiment depicted therein, it will be seen that each of orifices 93*a* and 96 preferably has an inwardly extending depth of at least from about 0.2 to about 0.5 times as great as length 89.

Referring again to FIG. 10, it will be seen that installation/removal bracket 90 is substantially U-shaped.

Figure 12:
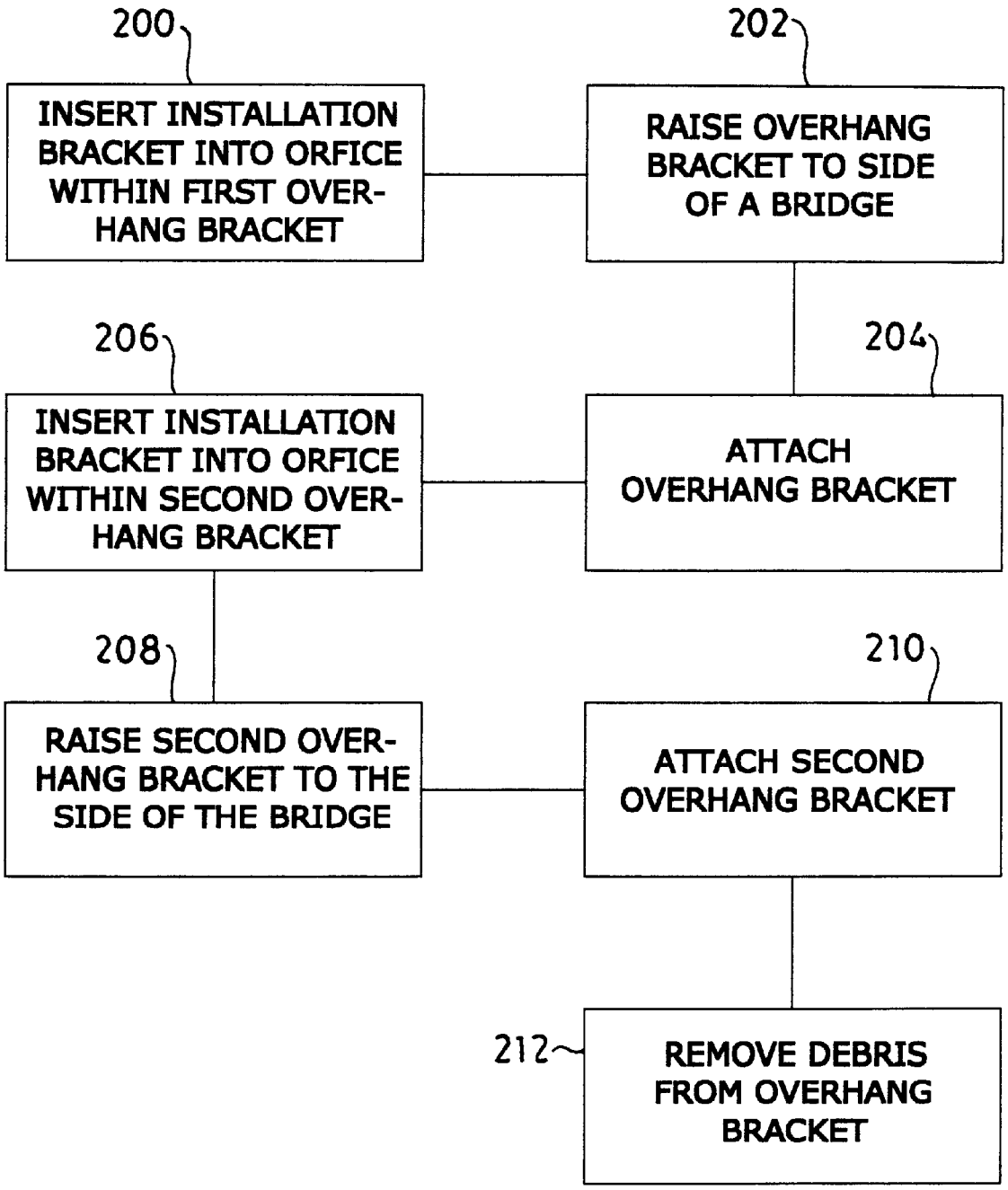
FIG. 12 is a flow diagram of another preferred process of the invention.

In one of the processes of this invention, and referring to FIG. 12, in step 200 U-shaped installation-removal bracket 90 is inserted into an orifice disposed within overhang bracket assembly 70. Thereafter, in step 202, the bracket deck 74/bracket frame 72 assembly is raised to the side of a bridge (not shown).

Once the overhang bracket assembly 70 has been raised to the side of a bridge (or of another suitable structure, such as a building), the overhang bracket 70 is attached to the structure in step 204, preferably by first cutting one or more orifices into the structure and then bolting the overhang bracket thereto. Thereafter, in step 206, the installation bracket 90 is inserted into a second overhang bracket (after having been removed from the first overhang bracket), the second overhang bracket is raised to the side of the bridge in step 208, and the second overhang bracket is attached to the bridge in step 210. It is preferred that the first and second overhang brackets be disposed so that they are contiguous with each other. The process may be repeated so until as many overhang brackets as are necessary are attached to the bridge. It is often preferred to use at least three such overhang brackets in certain particular locations.

Once the overhead bracket(s) are in place, debris will accumulate on such brackets and, preferably, should be removed therefrom periodically. The brackets may be allowed to permanently stay in place, or they may be removed.

Figure 13:
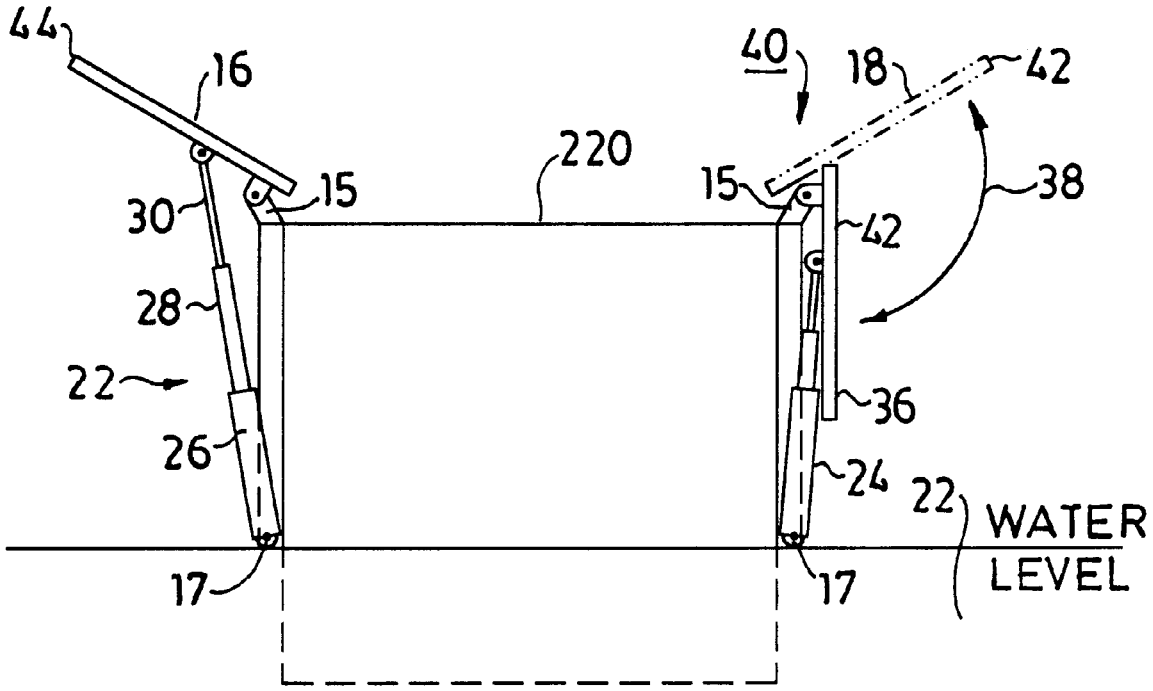
FIG. 13 is a perspective view of another preferred apparatus of the invention.

In another embodiment of the invention, depicted in FIG. 13, a floating receptacle 220 (such as a barge) disposed in a body of water 222 is equipped wings 16/18 of this invention and disposed under a bridge (not shown)

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. An overhang bracket for preventing the discharge of debris from a structure, wherein said overhang bracket is comprised of a bracket deck integrally connected to a bracket frame, and wherein:

(a) each of said bracket deck and said bracket frame consists essentially of a metal-containing material;

(b) said metal-containing material in the said bracket deck is in the form of a sheet with a thickness of from about 0.05 to about 0.6 inches, (c) each of said bracket deck and bracket frame have a length of from about 4 to about 20 feet, (d) said bracket deck is comprised of a horizontally-extending surface and, integrally connected thereto, a vertically-extending wall, wherein:

said vertically-extending wall has a height of at least about 1 inch, said vertically-extending wall is disposed with regard to said horizontally-extending surface at an angle of from about 60 to about 150 degrees, and said horizontally-extending surface has a width of from about 1 to about 10 feet;

(e) said bracket deck has a load capacity of from about 50 to about 1,000 pounds per square foot;

(e) said bracket frame is comprised of at least two triangular braces; and (f) said overhang bracket is comprised of an orifice which extends inwardly to a depth which is from at least 0.2 to about 0.5 times as great as said width of said horizontally-extending surface of said bracket deck.

2. The overhang bracket as recited in claim 1, wherein each of said bracket deck and said bracket frame consists essentially of a material selected from the group consisting of steel and aluminum.

3. The overhang bracket as recited in claim 2, wherein said steel material in said bracket deck is in the form of a sheet of steel with a thickness of from about 0.1 to about 0.5 inches.

4. The overhang bracket as recited in claim 3, wherein said overhang bracket has a length of from about 4 to about 15 feet.

5. The overhang bracket as recited in claim 4, wherein said horizontally-extending surface of said bracket deck is substantially smooth and contains no orifices or crevices.

6. The overhang bracket as recited in claim 4, wherein said bracket deck is welded to said bracket frame.

7. The overhang bracket as recited in claim 4, wherein said vertically-extending wall has a height of from about 3 to about 36 inches.

8. The overhang bracket as recited in claim 7, wherein said vertically-extending wall is disposed with regard to said horizontally-extending surface at an angle of from about 85 to about 95 degrees.

9. The overhang bracket as recited in claim 8, wherein each of said at least two triangular braces is a right-triangular brace.

10. The overhang bracket as recited in claim 9, wherein said orifice has a substantially rectilinear cross-sectional shape.

11. The overhang bracket as recited in claim 9, wherein said orifice has a substantially square cross-sectional shape.

12. The overhang bracket as recited in claim 9, wherein said orifice is disposed within said bracket deck.

13. The overhang bracket as recited in claim 9, wherein said orifice is disposed within said bracket frame.

* * * * *